United States Patent [19]

Crosslen

[11] 4,265,038

[45] May 5, 1981

[54] DISPLAY ASSEMBLY HAVING OVERLAPPING AND REMOVABLE SAMPLE HOLDERS

[75] Inventor: Louis J. Crosslen, Grafton, Wis.

[73] Assignee: Frank Mayer & Associates, Inc., Grafton, Wis.

[21] Appl. No.: 146,647

[22] Filed: May 5, 1980

[51] Int. Cl.[3] ..... G09F 1/10

[52] U.S. Cl. ..... 40/124.2

[58] Field of Search ..... 40/124.2, 10 R, 16, 40/122, 124; 211/50, 55

[56] References Cited

U.S. PATENT DOCUMENTS

| | | | |
|---|---|---|---|
| 814,438 | 3/1906 | Franke | 40/122 X |
| 2,963,808 | 12/1960 | Guichard | 40/124.2 |
| 3,507,064 | 4/1970 | Hammero | 40/124.2 |
| 4,081,080 | 3/1978 | Rorex | 40/124.2 |

*Primary Examiner*—Gene Mancene
*Assistant Examiner*—Wenceslao J. Contreras
*Attorney, Agent, or Firm*—James E. Nilles

[57] ABSTRACT

A display assembly for visibly displaying a wide variety of paint chips and permitting their easy removal from or replacement in the assembly. The assembly includes a plurality of individual holders arranged in partially overlapping and shingled relationship with one another on a support panel and in which the individual holders can be separately removed from the panel and from their interlocking relationship with other holders.

3 Claims, 7 Drawing Figures

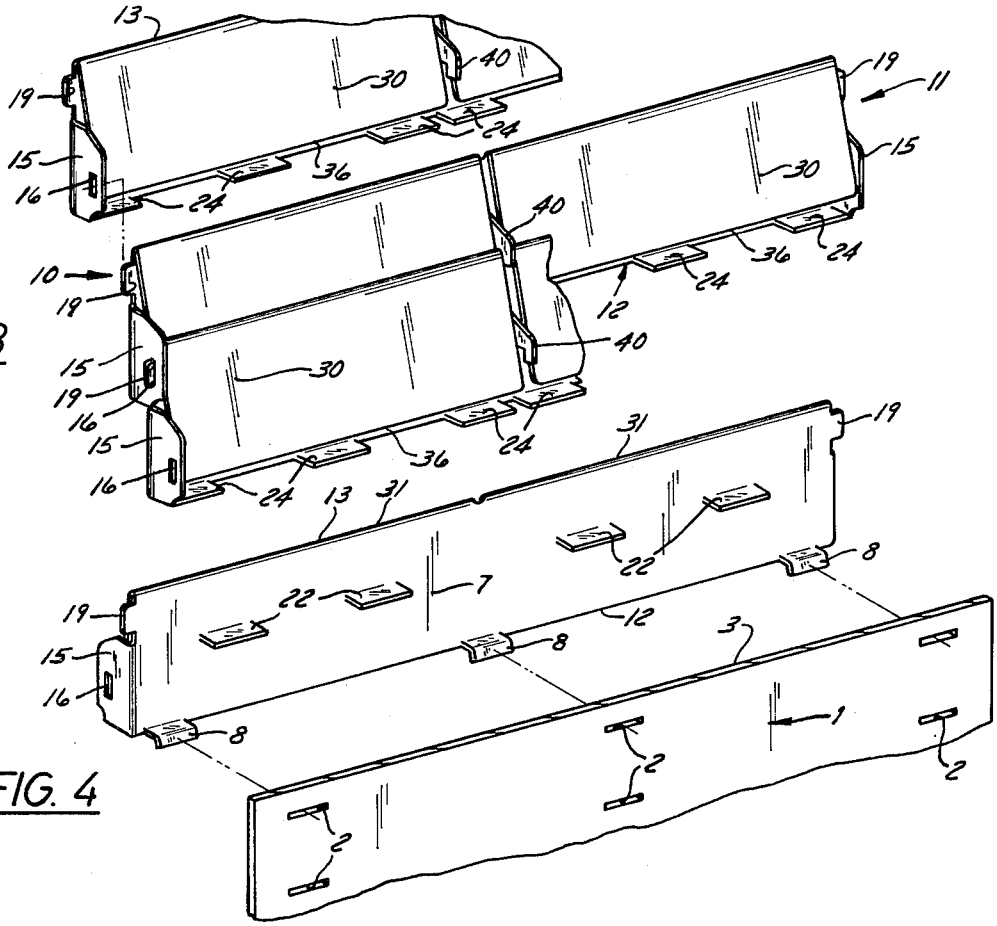
FIG. 3
FIG. 4
FIG. 5
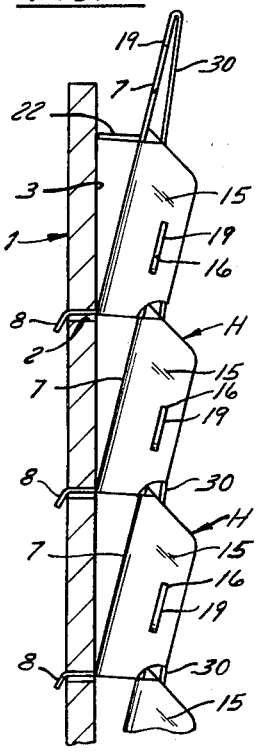
FIG. 6
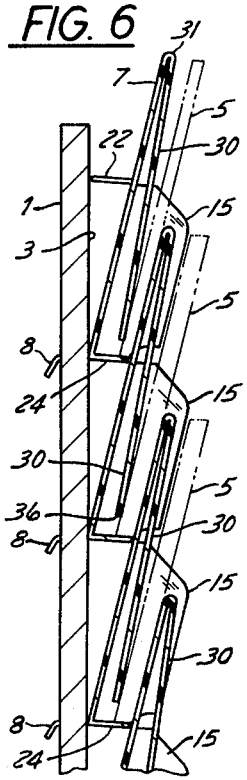
FIG. 7
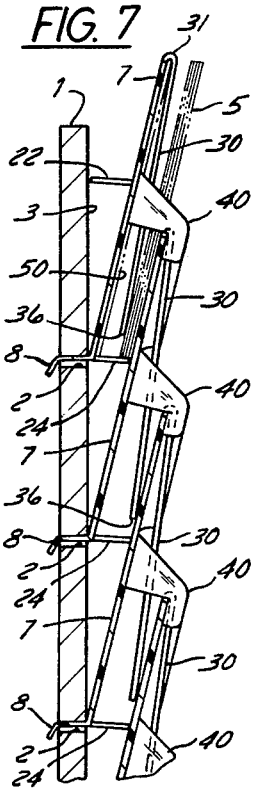

DISPLAY ASSEMBLY HAVING OVERLAPPING AND REMOVABLE SAMPLE HOLDERS

BACKGROUND OF THE INVENTION

Various prior art assemblies have been proposed for visually displaying a variety of paint chips or other samples and have been used with a certain degree of success. However, certain shortcomings have been noted in the prior art arrangements, for example, they tend to accidentally become disassembled when chips are removed therefrom, the chips are sometimes difficult to remove from or replace on the display and the various holders for the different groups of chips have been also difficult and time consuming to assemble and disassemble from the entire display.

SUMMARY OF THE INVENTION

The present invention provides a display assembly for a multiplicity of paint chips or other samples of sheet-like material and for storing said chips for clear visual observation and easy removal and replacement on the assembly. The assembly includes a generally vertical support panel on which are removably mounted a plurality of elongated holders that are arranged in partially overlapping shingled relationship on the panel. The arrangement is such that the upper portion of each holder is visible and the paint chips are removably inserted between adjacent holders for being readily observed or removed or replaced. The holders are formed from molded plastic material and are generally resilient in nature to insure their being readily assembled with one another by interengaging means therebetween. The arrangement is such that the paint chips are held firmly on their respective shelf means between the holders. Interlocking means are provided between the adjacent holders for holding them in firmly assembly relationship while at the same time permitting removal of any one holder without disassembly of the other holders.

These and other objects and advantages of the present invention will appear hereinafter as this disclosure progresses, reference being had to the accompanying drawings.

BRIEF DESCRIPTION OF THE DRAWINGS

FIG. 3 is a fragmentary, perspective view of three of the holders, one of the holders being removed from its assembled relationship with the adjacent holders, the view being taken generally from the front side of the display assembly;

FIG. 4 is a fragmentary, perspective view of a portion of the support panel and one of the holders in exploded relationship therewith, the view being taken from the back side of the assembly;

FIGS. 5, 6 and 7 are end views of the assembly, FIGS. 6 and 7 being sectional views taken generally along the lines 6—6 and 7—7 in FIG. 1.

DESCRIPTION OF A PREFERRED EMBODIMENT

The display panel provided by the present invention can accommodate various display samples such as paint chips or the like and which stores this variety of paint chips for complete visual observation and for easy removal of and replacement of the chips in the assembly.

The assembly includes a generally vertically arranged support panel 1 which may be of rectangular shape and which has a plurality of horizontal rows of mounting slots 2 therethrough. These rows of slots are vertically spaced apart from one another as shown clearly in FIGS. 1, 2, 4, 5 and 7. The support panel has a front mounting surface 3 against which the holders to be described are mounted in overlapping, shingled relationship.

Figure 2:
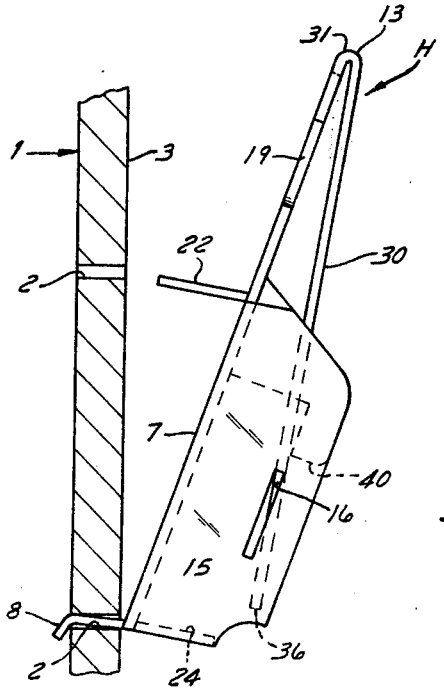
FIG. 2 is an enlarged end view of one of the holders and showing the back panel in section.

One of the holders H is shown in FIG. 2 and as each of the holders is identical in construction, only one will be described.

Generally, the holders are preferably molded from a transparent plastic material, such as K-resin. The holders are arranged in overlapping, shingled relationship so as to expose at least the upper portion thereof to easy view by the person selecting the sample contained in the holders. These samples may take the form of paint chips 5 and the chips are stacked between the holders as shown in FIGS. 6 and 7 so that one at a time may be easily removed simply by lifting it from between the holders.

Figure 1:
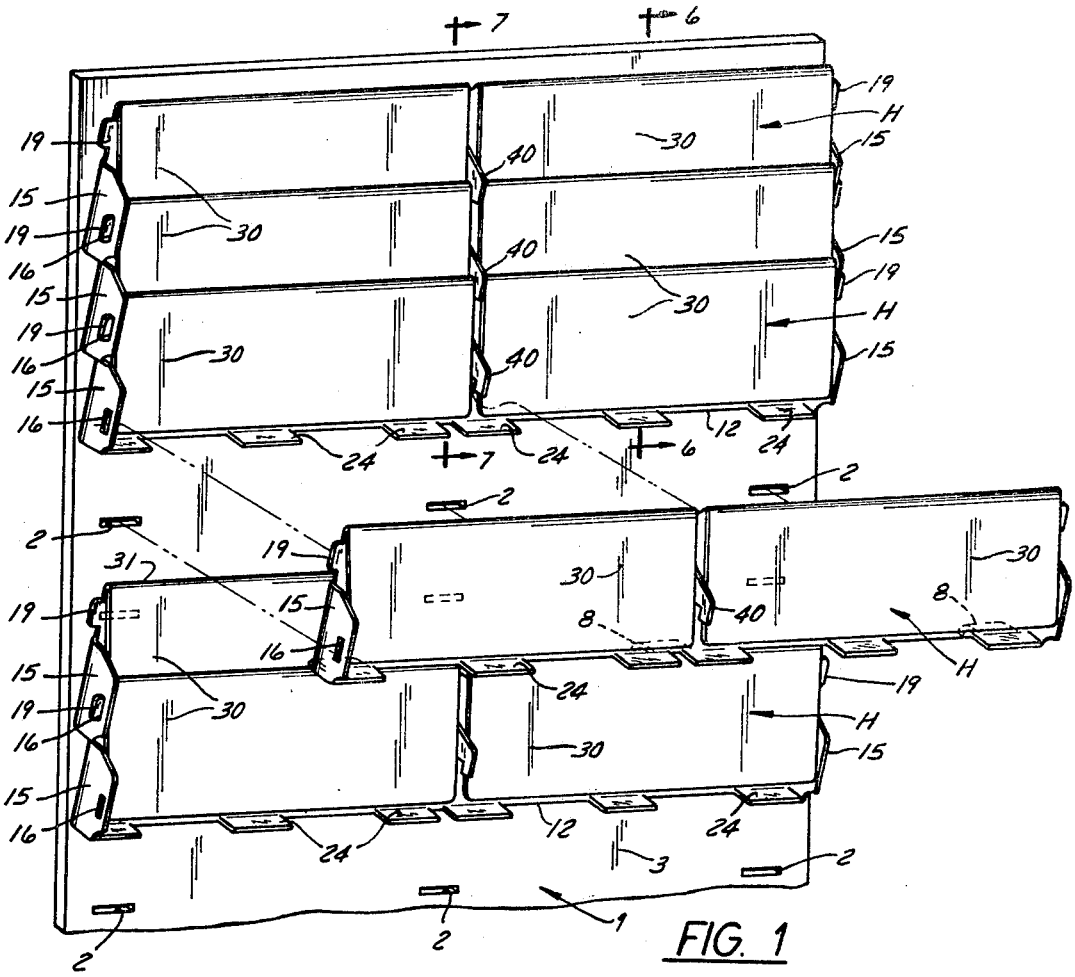
FIG. 1 is a perspective view of a display assembly provided by the present invention and showing one of the holders thereof removed therefrom.

The holders are generally elongated and as shown in FIGS. 1 and 4 extend across the front side of the panel.

The holders each comprise a back wall 7 having a row of horizontally aligned and rearwardly extending hooks 8 which are formed integrally therwith and along the lower edge of the back wall 7. These hooks are insertable in the mounting slots 2 of the support panel for removably supporting the holders on the panel as will more fully appear. The back wall 7 also has opposite ends indicated generally in FIG. 3 by numerals 10 and 11. The back wall also has a lower edge 12 and an upper edge 13 (FIGS. 3 and 4, respectively). A forwardly extending and vertically disposed end flange 15 extends from each end of the back wall and each flange has an aperture 16 extending therethrough. An end ear 19 extends endwise outwardly from each end of the back wall and these ears are located above the end flanges of the same back wall.

A back shelf means 22 extends rearwardly from the back wall and this means takes the form of horizontally spaced apart projections as clearly shown in FIG. 4. Front shelf means 24 (FIG. 3) extend forwardly from the lower edge of the back wall and the horizontal spacing of the shelf means 22 and front shelves 24 are such that the shelves are alternately spaced across the holder when the holders are assembled so as to form a single shelf means across the assembled holders.

The holders each also have a front wall 30 including an upper edge 31 formed integrally with the upper edge 13 of the back wall, the front wall being generally coextensive in length with the back wall. The front wall extends downwardly and outwardly in respect to the back wall and terminates in a lower edge 36. The front wall is resilient and can be pushed rearwardly against the rear wall whereby its free edge is biased to a forward position and can be pushed rearwardly to accommodate the paint chips thereagainst when the chips are inserted on the shelf means formed between and by adjacent partially overlapping holders.

Hook means 40 are attached to and extend forwardly from the rear wall and are engageable with the upper edge of the adjacent lower overlapping holder as shown clearly in FIGS. 3 and 7. Thus the hook means act to hold the next adjacent lower holder against forward tipping movement.

The end ears 19 of a particular holder are insertable in the apertures of the end flanges of the upper adjacent overlapping holder, as shown in FIGS. 1, 3 and 5 to thereby form an interlocking engagement between the holders.

With the present invention, it is an easy matter to assemble the holders in overlapping, shingled relationship with one another and on the support panel. As also shown in FIG. 1, any one of the individual holders may be separately removed in which case the holder below that one removed will assume the position shown in FIG. 2, but still be in a partially assembled relationship with the support panel.

As shown in FIG. 7, a paint chip 50 can be located between the front and rear walls of any one holder so that it is not removable but serves as a more or less permanent guide or reference for the supply of chips to be replenished when they are exhausted from their location between adjacent holders.

As shown in FIG. 7, the lower edge of the front wall is biased outwardly and against the chips 5 so as to push the chips forwardly against the forward holder and thus hold them in neatly assembled relationship and give the appearance that the supply of chips is adequate, that is that the space between the holders is filled with chips.

The holders, because they are formed of plastic, are bendable and resilient to a certain extent and thus insure that the holders can be readily assembled and snapped together with one another and can be easily attached to and removed from the support panel.

I claim:

1. A display assembly for storage of a variety of samples such as paint chips or the like for visual observation and easy removal of said samples for inspection, said assembly comprising, a generally vertical support panel having a plurality of horizontal rows of mounting slots therethrough, said rows being vertically spaced apart, said panel having a front mounting surface, a plurality of elongated paint chip holders mounted in overlapping relationship to one another on and horizontally across said panel on the said front mounting surface thereof, each of said elongated holders having, a back wall and a front wall having an upper edge formed integrally with an upper edge of said back wall and generally coextensive in length with said back wall, said front wall extending downwardly and outwardly in respect to said back wall and terminating in a lower, free edge; said front wall being resilient whereby its free edge is biased to a forward position and can be pushed rearwardly to accommodate samples thereagainst when said samples are inserted between adjacent overlapping holders, said holders having hooks for insertion in said mounting slots of said panel and for removably supporting said holders on said panel, and interengaging means between said holders for detachably connecting them together and means extending between said holders to provide shelf means for said samples.

2. A display assembly for storage of a variety of samples such as paint chips or the like for visual observation and easy removal of said samples for inspection, said assembly comprising, a generally vertical support panel having a plurality of horizontal rows of mounting slots therethrough, said rows being vertically spaced apart, said panel having a front mounting surface, a plurality of elongated paint chip holders mounted on and horizontally across said panel on the said front mounting surface thereof, said holders being molded from transparent plastic material and arranged in partially overlapping and shingled relationship with one another so as to expose to view at least an upper portion of each of said holders;

each of said elongated holders having, a back wall having (1) a row of horizontally aligned and rearwardly extending hooks formed integrally therewith and insertable in said mounting slots of said panel for removeably supporting said holders on said panel, said back wall having opposite ends, a lower edge and an upper edge, (2) a forwardly extending and vertically disposed end flange integrally formed with and extending from each end of said back wall, said flanges each having an aperture therethrough, (3) an end ear extending endwise outwardly from each end of said back wall and located above said end flanges on said back wall, (4) back shelf means extending rearwardly from said back wall and located intermediate the height thereof, (5) front shelf means extending forwardly from said back wall along the said lower edge thereof, (6) and hook means attached to and extending forwardly from said back wall, each of said holders also having a front wall having an upper edge formed integrally with an upper edge of said back wall and generally coextensive in length with said back wall, said front wall extending downwardly and outwardly in respect to said back wall and terminating in a lower, free edge; said front wall being resilient whereby its free edge is biased to a forward position and can be pushed rearwardly to accommodate samples thereagainst when said samples are inserted on said shelf means of and between adjacent partially overlapping holders, said hook means being engageable with the upper edge of a lower adjacent overlapping holder for holding the latter against forward tipping movement; the said end ears of a holder being insertable in said apertures of said end flanges of an upper adjacent overlapping holder to form an interlocking engagement therewith.

3. The assembly set forth in claim 2 further characterized in that said back shelf means of said back wall of one holder and the front shelf means of the back wall of an adjacent, upper holder are alternately spaced across the length of the holders to form a single shelf means and a generally continuous shelf upon which said samples may rest.

* * * * *